US011383967B2

(12) United States Patent
Nolan et al.

(10) Patent No.: US 11,383,967 B2
(45) Date of Patent: Jul. 12, 2022

(54) MONITORING BEVERAGE POURS

(71) Applicant: Barvision, LLC, Kennet Square, PA (US)

(72) Inventors: Joseph P. Nolan, Kennett Square, PA (US); Ian Johnston, Mission Viejo, CA (US); Geoffrey O. Nesnow, Princeton, NJ (US)

(73) Assignee: Barvision, LLC, Kennett Square, PA (US)

( * ) Notice: Subject to any disclaimer, the term of this patent is extended or adjusted under 35 U.S.C. 154(b) by 0 days.

(21) Appl. No.: 17/178,965

(22) Filed: Feb. 18, 2021

(65) Prior Publication Data

US 2021/0253415 A1 Aug. 19, 2021

Related U.S. Application Data

(60) Provisional application No. 62/977,895, filed on Feb. 18, 2020.

(51) Int. Cl.
*B67D 3/00* (2006.01)

(52) U.S. Cl.
CPC ..... *B67D 3/0051* (2013.01); *B67D 3/0006* (2013.01); *B67D 3/0077* (2013.01); *B67D 2210/00091* (2013.01)

(58) Field of Classification Search
CPC ..... Y02E 60/10; B67D 2210/00091; B67D 3/0006; B67D 3/0051; B67D 3/0077
See application file for complete search history.

(56) References Cited

U.S. PATENT DOCUMENTS

| | | | | |
|---|---|---|---|---|
| 5,916,425 | A | 6/1999 | Leader et al. | |
| 7,265,673 | B2 | 9/2007 | Teller | |
| 7,598,883 | B2 | 10/2009 | Morrison | |
| 2007/0222619 | A1* | 9/2007 | Moran | G01F 15/0755 340/573.1 |
| 2011/0166699 | A1* | 7/2011 | Palmquist | B67D 3/0041 700/236 |
| 2011/0180563 | A1* | 7/2011 | Fitchett | B67D 3/0077 222/1 |
| 2014/0263422 | A1* | 9/2014 | Brower | B67D 3/0041 222/23 |
| 2014/0312060 | A1* | 10/2014 | Heatherly | F16K 7/065 222/23 |
| 2015/0355012 | A1* | 12/2015 | Gurumohan | H04Q 9/00 702/55 |
| 2016/0025545 | A1* | 1/2016 | Saltzgiver | G01F 23/2962 73/304 C |
| 2016/0257554 | A1* | 9/2016 | Manwani | B67D 3/007 |

(Continued)

FOREIGN PATENT DOCUMENTS

WO WO-2016141322 A1 * 9/2016 ..... G07F 13/065

*Primary Examiner* — Vishal Pancholi
*Assistant Examiner* — Bob Zadeh
(74) *Attorney, Agent, or Firm* — BainwoodHuang

(57) ABSTRACT

Techniques for monitoring dispensed liquid include an intelligent spout that incorporates an IMU (Inertial Measurement Unit) for tracking its own orientation and movement in three-dimensional space. The spout has its own processor, memory, and wireless networking components, which support local data processing, data logging, and bi-directional wireless communication. Communication may be carried out with a server, with other spouts of like kind, and/or with other devices.

18 Claims, 7 Drawing Sheets

(56) References Cited

U.S. PATENT DOCUMENTS

| | | | | |
|---|---|---|---|---|
| 2018/0035297 | A1* | 2/2018 | Cronin | H04W 12/033 |
| 2018/0164143 | A1* | 6/2018 | Gurumohan | G01F 23/2962 |
| 2020/0143316 | A1* | 5/2020 | Anido | G06Q 10/087 |
| 2021/0253415 | A1* | 8/2021 | Nolan | B67D 3/0051 |

* cited by examiner

Spout DB 450a

| Spout ID | Label | Brand | Num Pours | Last Pour |
|---|---|---|---|---|
| . . . | | | | |

Bartender DB 450b

| BT ID | Name | Bracelet ID | Pour Signature |
|---|---|---|---|
| . . . | | | |

Pour DB 450c

| Pour ID | Spout ID | BT ID | Timestamp | Volume | POS Event | Video Clip(s) |
|---|---|---|---|---|---|---|
| . . . | | | | | | |

MONITORING BEVERAGE POURS

CROSS-REFERENCE TO RELATED APPLICATIONS

This application claims the benefit of U.S. Provisional Patent Application No. 62/977,895, filed Feb. 18, 2020, the contents and teachings of which are incorporated by reference herein in their entirely.

BACKGROUND

Improper and inaccurate beverage pours can cost businesses increased beverage consumption, lost revenue and expose them to liability. Frequent overpours of expensive drinks undercharge customers and undercut a bar's income. Overpours also present risks to customers, who may consume more alcohol than intended and suffer impairments in judgment or accidents. The bar may be held liable for any consequent harm that comes to customers or to others as a result of overpours. Frequent underpours also present risks to businesses, which may lose customer goodwill by providing less alcohol than customers expect. Inaccurate pours in mixed drinks, whether high or low, can impair taste and result in a poor customer experience.

To address harms and risks that can accompany inaccurate beverage pours, one manufacturer has developed a smart spout that attaches to the mouth of a bottle and monitors dispensed liquid. For example, U.S. Pat. No. 7,598,883 describes a spout that incorporates a mechanical tilt sensor, a timer, and an RF (Radio Frequency) transmitter. The spout is configured to activate in response to being tilted, such as when a bottle is tilted during a pour, and to measure the amount of time that the spout remains in the tilted state. The spout may detect multiple tilt angles. Electronics in the spout gather elapsed time and tilt state into a data packet, which may also include a unique identifier of the spout, such as a preassigned number. The bar may associate the preassigned number with a particular type of drink ingredient, such as a particular brand, for example. The spout transmits the packet in an RF signal to a local server. The server, such as a laptop computer or tablet, receives the packet via an RF antenna. The server extracts the tilt and timing data from the packet and stores the data in a database in connection with the unique spout identifier. In this manner, traceable data pertaining to overpours and underpours of particular beverages can be obtained.

SUMMARY

Unfortunately, the above-described smart spout has limited capabilities. For example, a common bartending scenario involves lining up multiple glasses in a row and sweeping a tilted bottle along the row. Given that the bottle is restored to vertical only after all of the glasses have been poured, the existing spout registers the activity as a single, long pour, rather than as multiple, shorter pours. More generally, the limited capabilities of existing spouts make them insufficient for many applications and scenarios that require more complete information about bartender activities and surrounding context.

In contrast with prior approaches, improved techniques for monitoring dispensed liquids include an intelligent spout that incorporates an IMU (Inertial Measurement Unit) for tracking its own orientation and movement in three-dimensional space. The spout includes a processor, memory, and wireless networking components. Enhanced capabilities of the intelligent spout enable many novel and useful applications.

In some examples, the spouts support local data processing, data logging, and bi-directional wireless communication. Communication may be carried out, for example, with a server, with other spouts of like kind, and/or with other devices.

As the intelligent spout tracks its own orientation and position in three-dimensional space, the intelligent spout can distinguish single long pours from multiple short pours by detecting its own horizontal movement along a line of cups or glasses.

According to some examples, the spout has one or more indicators, such as one or more LEDs (light emitting diodes) and/or transducers, such as speakers and/or piezoelectric devices (for emitting sound and/or vibration). The indicators enable the spout to communicate information to a user, such as a bartender or other service personnel. The LED(s) may be capable of emitting multiple colors, and/or different LEDs may be provided having different colors. The indicators may be coupled to the processor in the spout and may operate under computer control. For example, the processor may activate one or more indicators in response to detecting a pour or other event. Also, the spout may receive instructions from the server, another spout, or another device, and may respond to such instructions by activating one or more of the indicators.

According to some examples, the spout has a label that identifies a type of beverage, such as a particular brand. For example, the spout may be dedicated to a particular type of drink ingredient. The drink ingredient may be a premium brand or a house brand, such as a rail drink. The spout may be transferrable between bottles, such that the spout may be moved to a new bottle containing the same type of drink ingredient when the current bottle becomes empty. The label may be a pre-printed label, e.g., made of paper, plastic, metal, or the like, or it may be an electronic label (eLabel), which the processor in the spout has the ability to dynamically change. For example, if a bar stops selling a particular brand of drink ingredient, the bar may repurpose a spout previously assigned to that ingredient by directing the spout to electronically change the label. eLabels (also known as e-ink labels) require power only when changing displayed content and thus provides a good match for low-power operations involving the spout.

In some examples, the processor and associated electronics are encapsulated within an enclosure of the spout and are thereby protected from liquids, physical damage, and tampering.

In some examples, the spout measures an amount of beverage poured by repeatedly sampling its IMU over time. For example, the spout may identify a start pouring time in response to the spout tipping past a predetermined angle from vertical. The spout may generate an estimate of volume of the pour based on spout angle and elapsed time after the start time. The spout may further detect a stop pouring time in response to the spout tipping past the predetermined angle in an opposite direction. The start and stop times thus define an interval or duration of a pour.

In some examples, the spout, server, or other component stores viscosity data for the particular beverage being poured, and the volume poured from the spout is further estimated based on viscosity.

In some arrangements, the spout, server, or other device measures local temperature, and the volume poured is further estimated based on temperature.

In some arrangements, bottle physics may further inform pouring information. For example, the dimensions, shape, and weight (empty and full) may be combined mathematically with tilt angle and duration to provide accurate estimates of volume dispensed. Inertial changes along the tilting axis may also contribute to estimates of volume dispensed.

In some examples, the spout may communicate progress toward a complete pour using the indicators, such as the LED(s) and/or transducers. For example, the spout may start flashing a LED at the start of a pour, flash faster as the pour progresses, and turn solid when the pour is complete. A LED may also change color to indicate that the pour is complete. The bar may establish a complete pour as a designated volume, such as 1.5 ounces, 2.0 ounces, or the like. If the pour continues after the spout indicates completion, the spout may restart the LED sequence, e.g., assuming that the pour is a double. In some examples, the spout may activate an indicator in response to an overpour, alerting the bartender that too much alcohol is being dispensed.

In some examples, a sampling rate of the IMU is varied based on a detected angle of the spout. For instance, the spout may sample the IMU at a higher rate within the interval of the pour and at a lower rate outside that interval.

In some examples, the spout operates in a low-power sleep state when the IMU detects a stable, upright position, which is indicative of the bottle sitting on a shelf or table. The spout may make occasional measurements of the IMU during the sleep state, such as once per second. In response to detecting movement of the spout based on IMU measurements, the spout may exit the sleep state and enter an active state, during which it samples the IMU at a higher rate. While operating in the active state, the spout may measure any number of pours and may communicate its pour data to the server or other component, e.g., over a Bluetooth connection. The spout may return to the sleep state after detecting that it has returned to a stable, upright position, e.g., in response to a determined interval of low IMU activity.

In some examples, the spout may compensate for drift in the IMU in response to the bottle being placed vertically on a bar or other surface. For example, in response to detecting a period of low IMU activity, the spout may assume it has been placed upright and correct its IMU accordingly.

In some examples, the spout may detect when it has been removed from a bottle or other container. For example, removal of a spout from a bottle may be accompanied by a characteristic change in output from the IMU, based, for example, on initial stiction and then release. The spout may generate an event in response to the detected removal and transmit that event to the server. Detecting removal in this manner prevents tampering and promotes accuracy in tracking total amounts of beverages poured.

In some examples, the spout may belong to a cluster of multiple spouts, where clusters may be formed based on proximity. For example, a bar may include multiple serving stations at respective locations. Each serving station may have an assigned device that broadcasts an electromagnetic beacon, such as a Bluetooth beacon. Spouts may detect the nearest beacon and join the cluster from which the beacon originates.

Clusters may serve multiple purposes. For example, assigned devices may have higher power than spouts, have longer communication ranges than spouts, and may be capable of enhanced features, such as playing sounds, powering displays, storing large volumes of data, and/or performing complex data processing tasks. Some serving stations may be too far away from the server to allow for low-power Bluetooth communications between the spouts and the server. In such cases, assigned devices may act as communication gateways, using short-range Bluetooth signals with spouts in the same clusters but using longer range signals (Bluetooth or otherwise) for communication with the server. Such assigned devices may be referred to herein as "superspouts," even though there is no requirement for superspouts to operate as spouts. More generally, spouts and related devices may be arranged in a hierarchy, with devices at different levels having respective functions that differ from those of devices at other levels.

In some examples, spouts or other devices may respond to pour events by activating signs, lights, or other attention-attracting features to promote particular products. For instance, in response to detecting a pour event of a particular brand of beverage, a promotion for that brand may be illuminated or otherwise activated, letting persons in the vicinity know that the brand has been ordered. The promotions may extend to online services, such as social media platforms, which may register the pour data based on communication between the server and the social media platform.

In some examples, the server runs an application, such as an app or a browser, which accesses an array of data, such as information about pour events, service personnel, spouts, and/or the like. The application may provide access to a spout database, a bartender database, and/or a pour database, for example. The spout database tracks spout-specific information and associates spouts with corresponding brands of beverage. The bartender database tracks information about bartenders or other service personnel. The pour database tracks particular pours and may include, for example, spout identifiers, bartender identifiers, timestamps, volumes poured, and other factors.

In some examples, spout activities may be integrated with cameras. For example, one or more cameras may record video of the bar or other serving venue. In response to a spout detecting a pour event, the server or other component may note the time and generate references (e.g., links) to video from the cameras corresponding to the same point in time. The recordings may be rendered as short video clips, such as 30-second clips centered on the respective pour events. The server may provide links to videos in the pour database, such that users of the application can easily view video associated with particular pours by clicking the corresponding links. Multiple links may be provided for viewing video from respective cameras.

In some examples, the cameras may be controlled by a spout, the server, or some other device. For example, in response to a spout detecting a pour event, the spout or server may direct one or more of the cameras to focus on a particular area, to adjust exposure, and so forth. Cameras may therefore operate in response to input from the spouts, server, or other devices.

In some examples, spout activities may be integrated with POS (point of sale) devices, such as cash registers or other order-entry devices. In situations where a POS order is rung prior to pouring, the application may associate the POS entry with subsequent pours, e.g., pours that occur within a predetermined time interval following the POS entry. As the POS device may receive particulars of the order, such as a type of mixed drink ordered, the application may expect certain beverages to be poured. In some examples, the application may direct the spouts on bottles needed to complete the order to illuminate (via a LED) or otherwise to identify themselves, to guide the bartender to the appropriate beverages. In some examples, the pour database stores POS order data, thereby associating particular pours with corresponding orders. The pour database may further associate pours with bartenders, video, and other available data. In situations where a POS order is rung after pouring, the application may associate the POS entry with prior pours, e.g., pours that occurred within a predetermined period prior to the POS entry. The ability to associate beverage pours with POS entries provides objective and auditable data. Such data may be used to establish fair prices for parties and other events.

In some examples, the spout includes a kinematics engine that receives input from the IMU and monitors acceleration, orientation, and/or position of the spout. By recording these factors for a particular person over multiple pours, the kinematics engine may generate a characteristic of pours associated with that person. For example, each bartender or other service personnel has a particular pouring signature, which may be based on whether the person is right-handed or left-handed, on lengths of the person's limbs, on joint positions, and so forth. Once a person's pouring signature has been characterized, the signature may be used as a basis for uniquely identifying that person and distinguishing that person from other people. In this manner, the spout and/or server can associate a particular pour with a specific person, enabling pouring patterns of that person, such as overpours and underpours, to be determined and recorded. In some examples, the acts of characterizing and matching pouring signatures involve machine learning and/or neural networks, such as convolutional neural nets.

In some examples, bottle physics may play a role in identifying pouring signatures, which may vary, for example, based on bottle weight and geometry. For example, signatures may be allowed to differ for the same service personnel when using bottles of different size, shape, and/or weight. Matching signatures to service personnel may thus take bottle geometry into account. For instance, a bartender may be associated with multiple signatures, e.g., one for small bottles, one for medium-sized bottles, and one for large bottles.

In some examples, bartenders and other service personnel may be provided with wearable identifiers, such as ID bracelets, which uniquely identify such personnel. For example, an ID bracelet may emit an RFID (Radio Frequency Identifier) or Bluetooth signal, which may be detected by the spout and may serve as a basis for associating subsequent pours with the person identified by the bracelet.

According to some examples, pouring performance of service personnel may be gamified and compared with performance of other service personnel to provide incentives and rewards. Recorded pours during a particular shift may be compared with POS data from the same shift to identify agreements and disparities. The application can determine how many overpours and underpours were served, how many doubles were poured as singles or vice-versa, whether any substitutions were made (premium for rail or vice-versa) and the like. Scores may be tallied for different bartenders, providing objective measures of performance.

Certain embodiments are directed to a spout configured to attach to a mouth of a bottle. The spout includes a passageway extending through the spout and configured to pass liquid out of the bottle, an IMU (inertial measurement unit) configured to track orientation and movement of the spout in three-dimensional space, and wireless communication circuitry configured to communicate bidirectionally with other electronic equipment that is not part of the spout.

Other embodiments are directed to a method of monitoring beverage pours. The method includes providing a spout attached to a mouth of a bottle, the spout housing electronic circuitry that includes (i) an IMU (inertial measurement unit) and (ii) wireless communication circuitry configured to communicate bidirectionally with a server computer. The method further includes detecting, by the spout, a pour event based at least in part on the IMU measuring orientation and movement of the spout in three-dimensional space, and wirelessly transmitting information about the pour event to the server computer.

Still other embodiments are directed to computer program products. The computer program products store instructions which, when executed by control circuitry of a computerized apparatus, cause the computerized apparatus to perform any of the techniques described above.

The foregoing summary is presented for illustrative purposes to assist the reader in readily grasping example features presented herein; however, this summary is not intended to set forth required elements or to limit embodiments hereof in any way. One should appreciate that the above-described features can be combined in any manner that makes technological sense, and that all such combinations are intended to be disclosed herein, regardless of whether such combinations are identified explicitly or not.

BRIEF DESCRIPTION OF THE SEVERAL VIEWS OF THE DRAWINGS

The foregoing and other features and advantages will be apparent from the following description of particular embodiments, as illustrated in the accompanying drawings, in which like reference characters refer to the same or similar parts throughout the different views. The drawings are not necessarily to scale, emphasis instead being placed upon illustrating the principles of various embodiments.

DETAILED DESCRIPTION

Embodiments of the improved technique will now be described. One should appreciate that such embodiments are provided by way of example to illustrate certain features and principles but are not intended to be limiting.

Improved techniques for monitoring dispensed liquid include an intelligent spout that incorporates an IMU (Inertial Measurement Unit) for tracking its own orientation and movement in three-dimensional space. The spout has its own processor, memory, and wireless networking components, which support local data processing, data logging, and bi-directional wireless communication. Communication may be carried out with a server, with other spouts of like kind, and/or with other devices.

Figure 1:
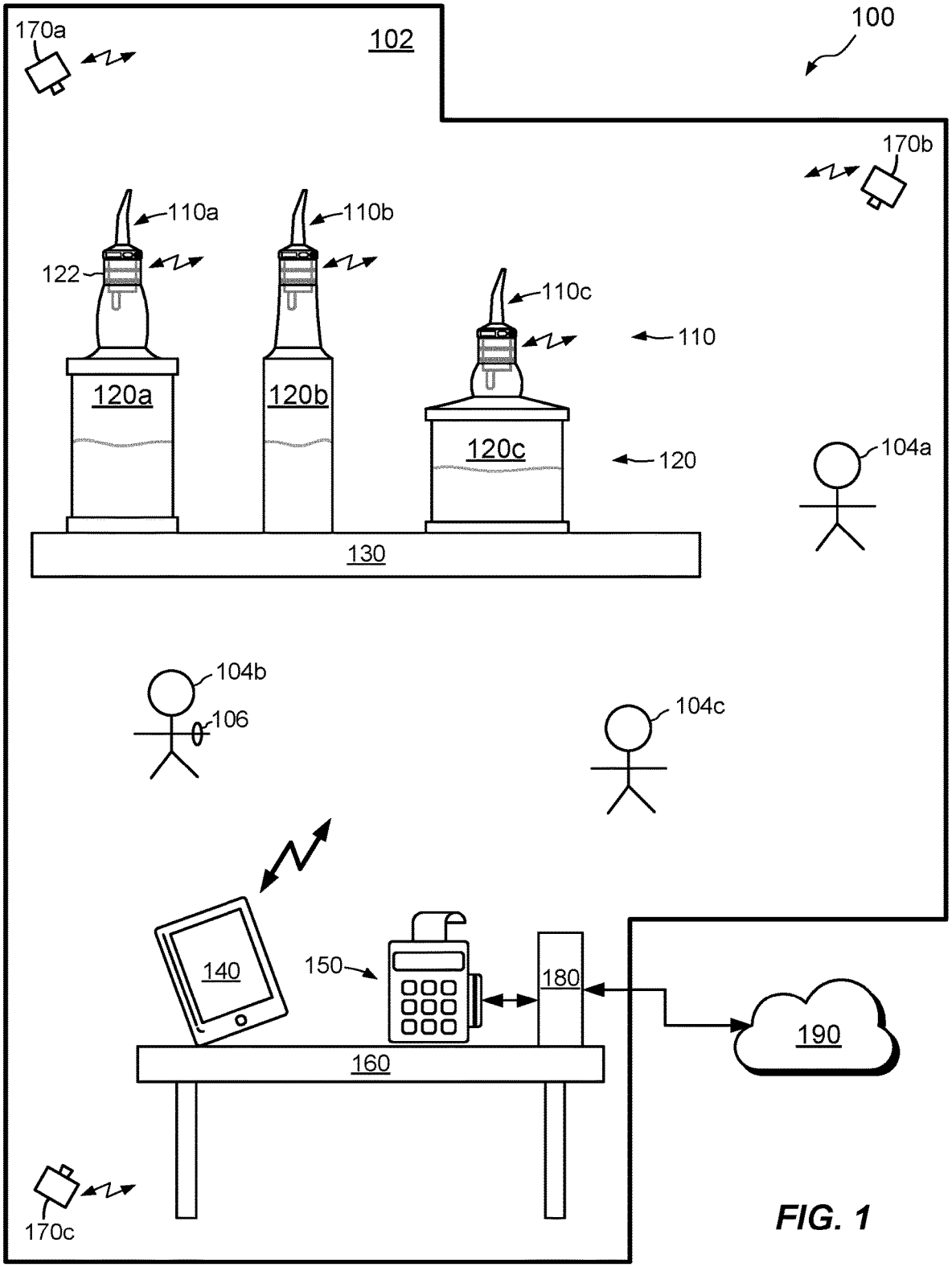
FIG. 1 is a block diagram of an example environment in which embodiments of the improved technique can be practiced.

FIG. 1 shows an example environment 100 in which embodiments of the improved technique can be practiced. As shown, the environment 100 includes a bar 102 or other physical space, which may be indoors or outdoors. Any number of bartenders or other service personnel 104 (104*a*, 104*b*, 104*c*; hereinafter referred to as "bartenders") may work in the space 102. One or more of the bartenders 104 may have a wearable identifier 106, such as an ID bracelet that uniquely identifies the bartender. For example, the ID bracelet 106 may emit an RFID (Radio Frequency Identifier) or Bluetooth signal, which may be detected by the spout 110 and serve as a basis for associating subsequent pours with the bartender identified by the bracelet. Intelligent spouts 110 (110*a*, 110*b*, and 110*c*) are installed in mouths 122 of respective bottles 120 (120*a*, 120*b*, and 120*c*), which sit on a shelf 130. Each spout 110 is associated with a respective type of drink ingredient, e.g., with a particular product.

Also shown in the environment 100 is a server 140 and a POS (point of sale) device 150, such as a cash register or other order-processing device. The server 140 may be provided as any type of computing device, such as a desktop computer, laptop computer, tablet computer, smart phone, PDA (personal data assistant) or the like. The server 140 and POS device 150 may be placed on a desk 160 or other surface, but they could be located anywhere in the space 102 or in nearby spaces. One or more cameras 170 (170*a*, 170*b*, and 170*c*) may be positioned around the space 102 and may be configured to record activities therein. The spouts 110, server 140, POS device 150, and cameras 170 together form an electronic system of components, which are linked together by wireless and/or wired connections. For example, spouts 110 may be linked to one another and to server 140 via Bluetooth. Server 140 may be linked to POS 150 via Bluetooth, Wi-Fi, or a wired connection (e.g., Ethernet). Server 140 may be linked to cameras 170 via Bluetooth, Wi-Fi, or a wired connection. A wireless router 180 may support Wi-Fi and Ethernet communications in the space 102 and may provide access to a WAN (Wide Area Network) 190, such as the Internet. In some examples, the server 140 connects to an Internet site or cloud service, e.g., for coordinating activities among multiple sites, for managing software updates, and the like.

In example operation, bartenders 104 serve drinks to customers (not shown) in or around the space 102. The drinks may include any combination of beverages, which are contained in bottles 120. As a bartender 104 pours a beverage from a bottle 120, the spout 110 on that bottle generates a pour event, measuring aspects of the pour. The spout 110 may then communicate data describing the pour event to the server 140. The server 140 records the pour event in a database. In some examples, the server 140 may associate the pour event with an order entry in POS device 150 and/or with video or still images acquired by one or more of the cameras 170.

In some examples, the server 140 associates pour events with bartenders 104 who perform the pours. For example, associations are established by reading wearable identifiers 106, by matching detected pour signatures of bartenders 104 with learned pour signatures for those bartenders 104, by processing video from cameras 170, and/or in other ways. In this manner, the system may detect overpours and underpours, product substitutions, and other errors, and may associate such errors with particular bartenders 104.

Figure 2:
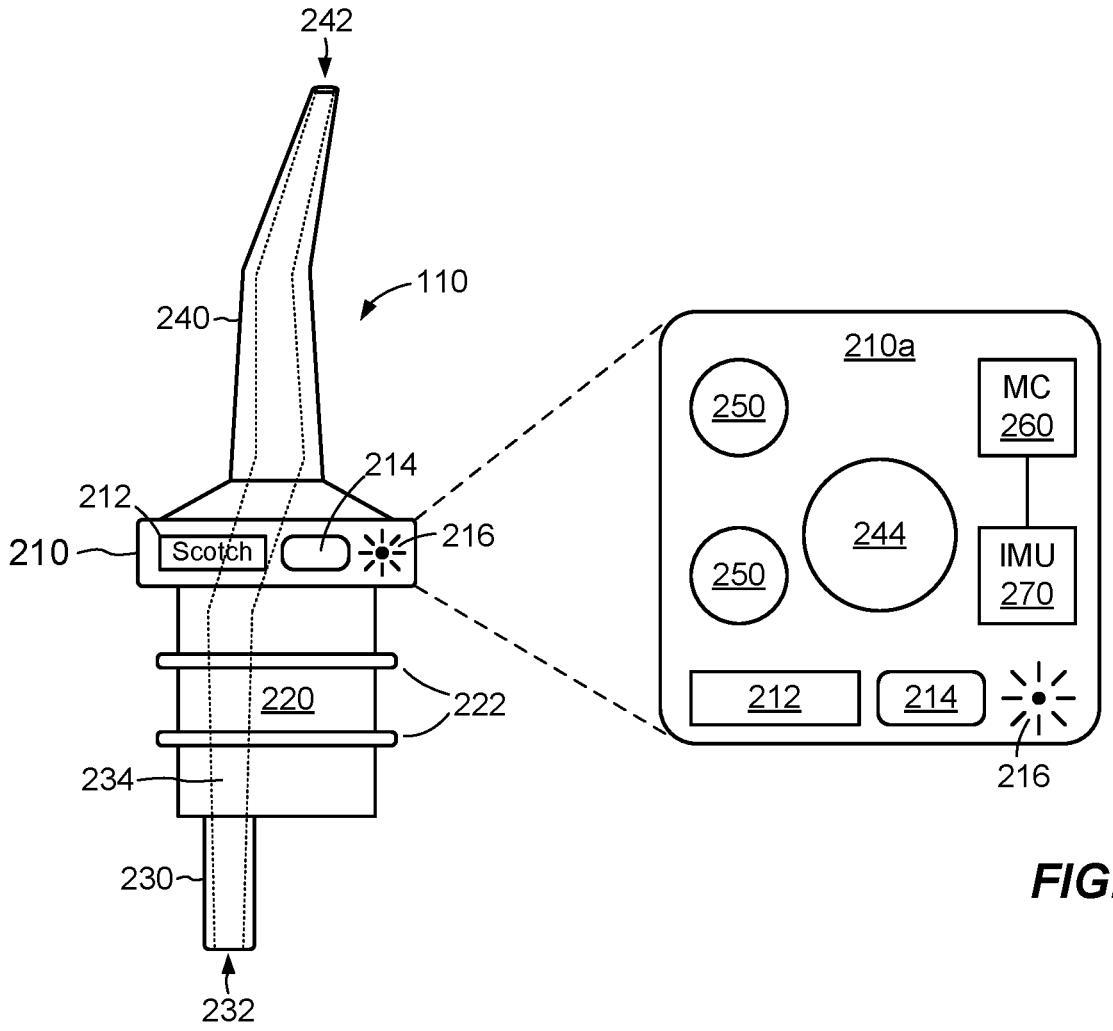
FIG. 2 is a front plan view of an example spout of FIG. 1 and further shows a top plan view of a circuit assembly encapsulated within the example spout.

FIG. 2 shows an example intelligent spout 110 in greater detail. As shown, spout 110 includes a body or enclosure 210, a barrel 220 extending from the body 210, an inlet tube 230, and an outlet tube 240. An internal passageway 234 connects an opening 232 in the inlet tube 230 to an opening 242 in the outlet tube 240 and thus allows liquid to pass therebetween. In some examples, a second passageway (not shown) is formed through the body 210, e.g., to allow air to pass into a bottle to which the spout 110 is attached for equalizing pressure.

The barrel 220 is configured to insert into the mouth 122 of a bottle 120 (FIG. 1). Barrel 220 may have one or more stopper rings 222, each of which extends around the barrel 120 to assist in retaining the barrel 220 within the bottle 120 and preventing leakage.

As further shown in FIG. 2, the enclosure 210 may have an externally visible label 212, a transducer 214, and one or more LEDs (light emitting diodes) 216. The label 212 is configured to identify the particular drink ingredient (e.g., "Scotch") to which the spout 110 has been associated. The label 212 may display any desired details about the ingredient, such as its brand, whether the ingredient is a premium drink or a rail drink, and the like. It may include text and/or graphics, such as a logo. In some examples, the label 212 includes electronic paper, which is programmable to display desired content. Electronic paper (ePaper) has the advantage of requiring no power to retain its displayed content once that content has been programmed. Transducer 214 may be a mini-speaker or piezoelectric source, for example, which is configured to generate sound, other vibration, and/or haptic feedback, e.g., for communicating kinesthetically with bartenders 104. LED(s) 216 are configured to communicate with bartenders 104 or others by emitting light, such as pulses of light, light of various colors, etc.

Shown to the right of FIG. 2 is an example circuit assembly 210*a*, which may be contained within the enclosure 210. For example, the circuit assembly 210*a* may be potted or otherwise encapsulated within the enclosure 210, in a manner which allows the label 212, transducer 214, and LED(s) 216 to be viewed or otherwise perceived from the outside. As shown, circuit assembly 210*a* may include one or more batteries 250 (e.g., lithium cells), a processor such as a microcontroller 260, and an IMU 270. Circuit assembly 210*a* may further include various support circuitry (e.g., bypass capacitors, pull-up resistors, etc.) which are omitted from the figure for the sake of simplicity. Circuit assembly 210*a* may further include a hole 244 for accommodating passageway 234. Other embodiments use different packaging techniques and may not require a hole 244.

Microcontroller 260 is preferably a small, very low power SoC (system on a chip), which includes a processor, RAM (random access memory), and persistent memory (e.g., flash). It also preferably includes a built-in Bluetooth antenna and associated circuitry. A suitable example of microcontroller 260 is the RSL10 Multi-Protocol System-on-Chip, which is available from ON Semiconductor of Phoenix, Ariz.

IMU 270 preferably includes accelerometers and gyroscopes for tracking position, movement, and orientation in three-dimensional space. A suitable example of IMU 270 is the LSM6DS0, which is available from STMicroelectronics of Geneva, Switzerland. The LSM6DS0 also measures temperature and has a six-axis sensor for measuring up to six forces and torques simultaneously.

When equipped with very low power electronics, such as the components described above, the spout 110 is expected to have a long service life and never to require recharging or battery replacement. Of course, the ability to recharge or replace batteries may be provided if desired.

Figure 3:
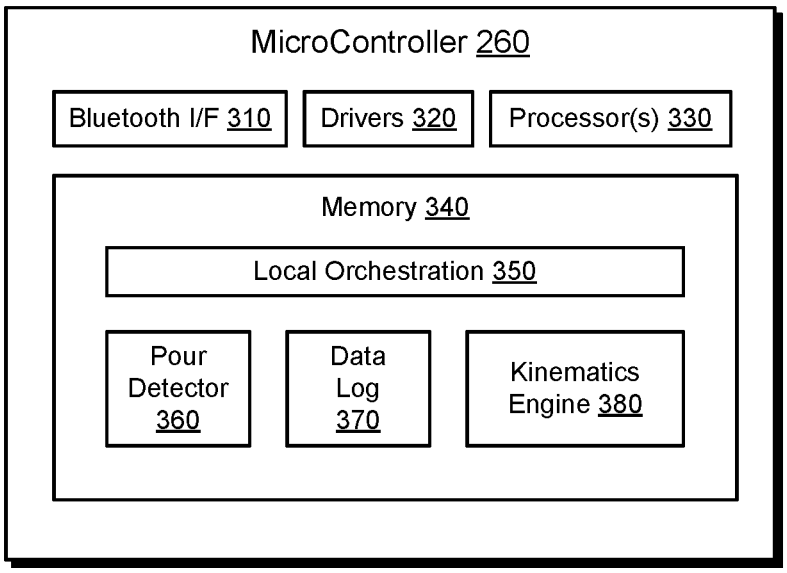
FIG. 3 is a block diagram of example functional components of a processor in the spout of FIG. 2.

FIG. 3 shows aspects of the microcontroller 260 in additional detail. As shown, microcontroller 260 includes a Bluetooth interface 310, various drivers 320, one or more processors 330, and memory 340. The RLS10 includes a dual-core ARM (advanced RISC machine) architecture, which provides sufficient processing power for the intended applications. The memory 340 may include both volatile memory (e.g., RAM) and non-volatile memory, such as one or more ROMs (Read-Only Memories), flash memory, solid state memory, and the like. The processor(s) 330 and the memory 340 together form control circuitry, which is constructed and arranged to carry out various methods and functions as described herein. Also, the memory 340 includes a variety of software constructs realized in the form of executable instructions. When the executable instructions are run by the processor(s) 330, the processor(s) 330 carry out the operations of the software constructs.

As further shown in FIG. 3, the memory 340 "includes," i.e., realizes by execution of software instructions, local orchestration 350, pour detector 360, data log 370, and kinematics engine 380. The local orchestration 350 is configured to control main software operations of the spout 110, such as communications over Bluetooth, operations of label 212 and indicators 214 and 216, transitions between sleep state and waking state, and other functions needed to support operation and communication.

Pour detector 360 is configured to detect pours from the spout 110. For example, the pour detector 360 may identify a start pouring time in response to the spout 110 tipping past a predetermined angle from vertical, such as 40 degrees. The pour detector 360 may generate an estimate of volume of a pour based on spout angle and elapsed time after the start time. The pour detector 360 may further detect a stop pouring time in response to the spout tipping past the predetermined angle in an opposite direction. In some examples, the spout 110, server 140, or other component stores viscosity data for the particular beverage being poured, and the volume poured from the spout 110 is further estimated based on viscosity. In some arrangements, the spout 110, server 140, or other device measures local temperature, and the volume poured is further estimated based on temperature.

Data log 170 is configured to store data related to pours and/or other events. For example, spout 110 may accumulate data and hold the data temporarily pending transmission to the server 140. With this arrangement, spout 110 may temporarily lose Bluetooth connectivity to the server 140 but may continue to operate normally, logging data related to new pours and sending the accumulated data to the server 140 once connectivity is reestablished. Therefore, no pour data need be lost.

Kinematics engine 380 is configured to track, based on input from IMU 270, movements and orientations of the spout 110 associated with pour events. For example, kinematics engine 380 analyzes multiple pour events for a given bartender 104 and characterizes the particular movements of that bartender while executing pours, generating a pour signature specific to that bartender.

The pour signature for each bartender may be based on whether the bartender is right-handed or left-handed, on lengths of the bartender's limbs, on joint positions, and so forth. Once the kinematics engine 380 has characterized a bartender's pour signature, it may apply that signature as a basis for uniquely identifying that bartender later. For example, the kinematics engine 380 may sample the IMU 270 during a pour by an unknown bartender, generate a signature for that pour, and then search for a match to that signature in a database. A matching signature uniquely identifies the bartender. In this manner, the spout 110 and/or server 140 can associate particular pours with respective bartenders 104, enabling pouring behaviors or bartenders 104 to be tracked and recorded. In some examples, the kinematics engine 380 acts in cooperation with other devices, such as server 140 or some other device, to perform computationally intensive tasks associated with signature characterization and matching. Such tasks may include the application of machine learning and/or convolutional neural networks.

Figures 4, 5, 6, 7:
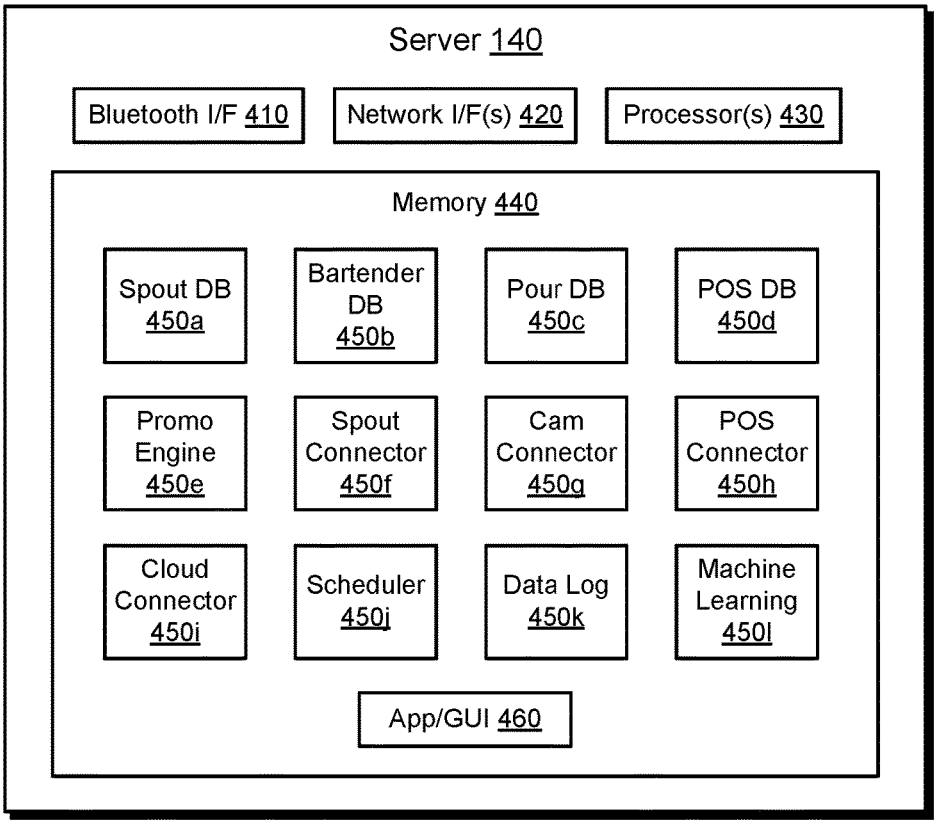
FIG. 4 is a block diagram of example functions of a server of FIG. 1.
FIG. 5 is a block diagram of an example spout database.
FIG. 6 is a block diagram of an example bartender database.
FIG. 7 is a block diagram of an example pour database.

FIG. 4 shows aspects of the server 140 in additional detail. As shown, the server 140 includes a Bluetooth interface 410, one or more network interfaces 420, a set of processors 430, and memory 440. The set of network interfaces 420 may include, for example, Wi-Fi (IEEE 802.11), Ethernet, and/or the like. The set of processors 430 may include one or more processing chips and/or assemblies. The memory 440 may include volatile memory (e.g., RAM) and non-volatile memory, such as one or more magnetic disk drives, electronic flash drives, or the like. The set of processors 430 and the memory 440 together form server control circuitry, which is constructed and arranged to carry out various server methods and functions as described herein. Also, the memory 440 includes a variety of software constructs realized in the form of executable instructions. When the executable instructions are run by the set of processors 430, the set of processors 430 carry out the operations of those software constructs.

As further shown in FIG. 4, memory 440 may include the following:

Spout Database 450*a*. Database of spouts 110. As shown in FIG. 5, spout database 450*a* may store a respective record for each spout 110. The records may include, for example, fields for a unique spout identifier, contents of label 112, a brand or type of beverage to which the spout 110 is assigned, a total number of pours made by the spout 110, and a last (most recent) pour made by the spout 110. In some examples, the unique spout identifier is formed as a combination of a MAC (media access control) address and a secondary address assigned by the owner.

Bartender Database 450*b*. Database of bartenders 104. As shown in FIG. 6, bartender database 450*b* includes, for example, fields for a unique bartender ID (e.g., employee number), name, bracelet ID (of bracelet 106), and pour signature (i.e., a unique kinematic signature of the bartender's characteristic pouring motion).

Pour Database 450*c*. Database of pour events. As shown in FIG. 7, pour database 450*c* includes, for example, fields for a unique pour ID, spout ID (FIG. 5), bartender ID (FIG. 6), a timestamp, a volume poured as measured by the respective spout 110, an associated POS event (e.g., an order entered in POS 150), and one or more associated video clips or still images of the pour (e.g., as obtained by cameras 170).

POS Database 450*d*. Database of drink orders entered into POS system, such as POS device 150. In some examples, POS database 450*d* may be hosted externally to server 140, e.g., on POS device 150 or on a separate POS server (not shown).

Promo Engine 450*e*. Software construct that delivers promotions in response to events, such as pour events. For instance, in response to detecting a pour event of a particular brand of beverage, promo engine 450*e* may provide a promotion for that brand, e.g., by activating signs, lights, or other attention-attracting features in the space 102. The promotions may extend to online services, such as social media platforms, which may register the pour data based on communication between the server 140 and the social media platform.

Spout Connector 450*f*. Software interface to spouts 110. Manages receipt of pour data from spouts 110. May provide data and firmware updates to components on spouts 110. May issue commands to spouts 110, e.g., to activate indicators 114 and/or 116, to change eLabel 112, and so forth.

Cam Connector 450*g*. Software interface to cameras 170. Manages receipt of video and identification of video clips coincident with pour events. May associate video clips and/or still images with events in pour database 450*c*. May control one or more cameras 170 in response to detection of pour event from a spout 110.

POS Connector 450*h*. Software interface to POS device 150. May access POS data and associate POS data with pour events in pour database 450*c*.

Cloud Connector 450*i*. Software interface to cloud server. May connect to cloud server to receive software updates and support comparisons of data across multiple sites.

Scheduler 450*j*. Software construct that adjusts activities of server 140 based on day and time, e.g., based on whether bar is open or closed, based on shift, etc.

Data Log 450*k*. Software construct that supports data logging by spouts 110 as well as other data logging needs of system.

Machine Learning Engine 4501. Applies machine learning algorithms and/or neural networks to support generation and matching of pour signatures. May also be used for trend analysis, for associating POS data with pour events, for associating video clips with pour events, and so forth.

In addition, memory 440 may further include an application (app) 460, which may be operable by an owner or manager via a GUI (graphical user interface). For example, the app 460 allows users to access contents of databases 450*a*-450*d*, generate analytics, and perform other functions.

Figure 8:
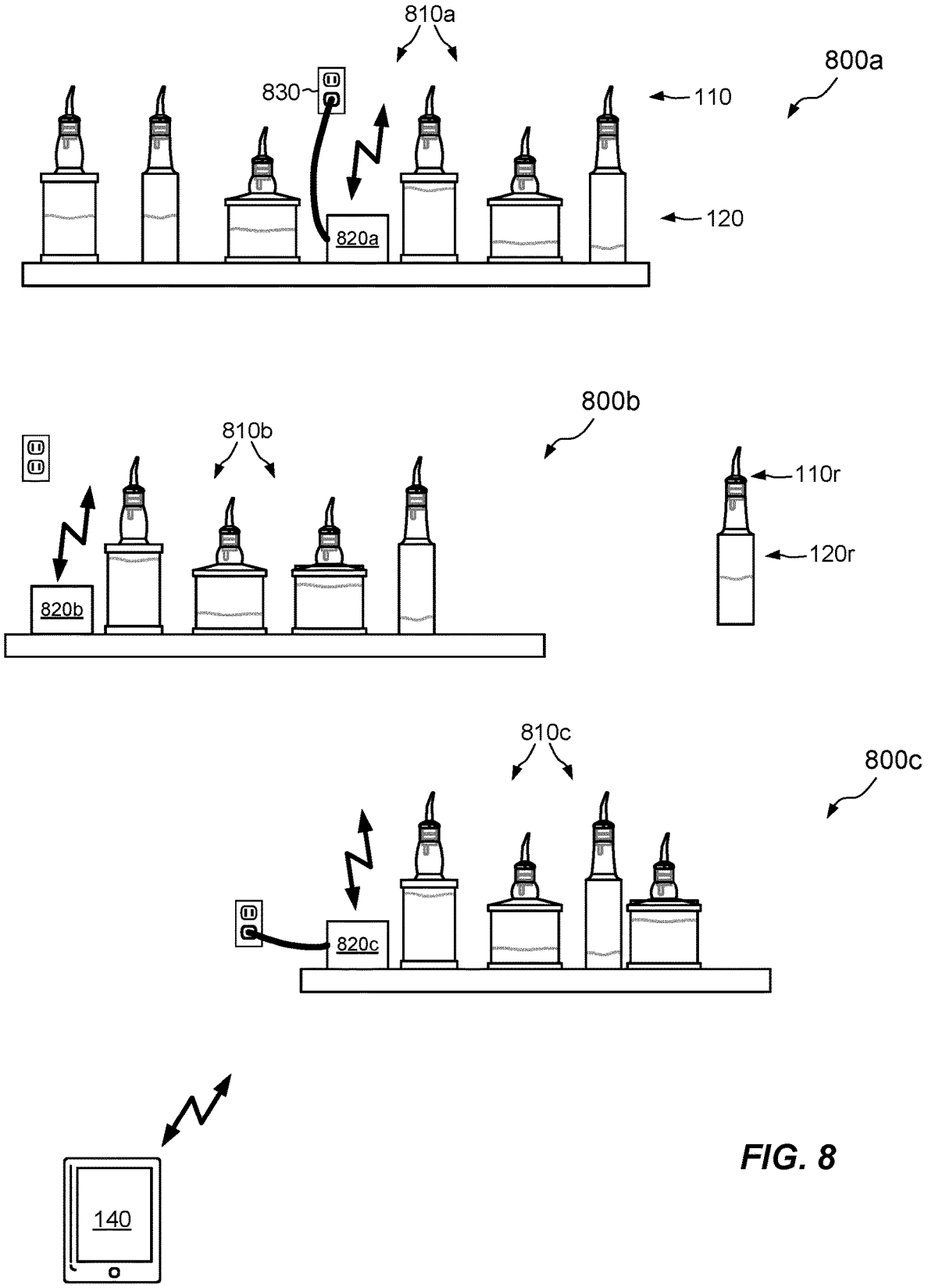
FIG. 8 is a block diagram of example serving stations in the environment of FIG. 1.

FIG. 8 shows an example arrangement in which a bar or other venue has multiple serving stations 800 (e.g., 800*a*, 800*b*, 800*c*). The serving stations 800 may be located in respective areas of the space 102. In accordance with certain embodiments, spouts 110 form clusters 810 (e.g., 810*a*, 810*b*, 810*c*) based on vicinity to other spouts 110. For example, each serving station 800 may have an assigned device 820 (e.g., 820*a*, 820*b*, 820*c*), such as a superspout, that broadcasts an electromagnetic beacon, such as a Bluetooth beacon. Spouts 110 may detect the nearest beacon and join the cluster 810 from which the nearest (e.g., strongest) beacon originates.

Spouts 110 may join or leave clusters 810 based on proximity. For example, a spout 110*r* on bottle 120*r* may roam around the area 102. In response to detecting a beacon from device 820*b*, spout 110*r* may join cluster 810*b* in station 800*b*. If spout 110*r* is later moved to station 800*a*, spout 110*r* may leave cluster 810*b* and join cluster 810*a*.

Clusters 810 may serve multiple purposes. For example, assigned devices 820 may have higher power than spouts 110, may have longer communication ranges than spouts 110, and may be capable of enhanced features, such as playing sounds, powering displays, and/or performing complex data processing. Assigned devices 820 may use larger power sources than do spouts 110. For example, devices 820 may be plugged in to electrical outlets 830 to receive line power and/or may have larger batteries than do spouts 110.

Some serving stations 800 may be too far away from the server 140 to allow for low-power Bluetooth communications between spouts 110 and the server 140. In such cases, assigned devices 820 may act as communication gateways for spouts 110 belonging to respective clusters 810. Such devices 820 may use short-range Bluetooth for communicating with spouts 110 in the same clusters 810 but may use longer-range Bluetooth (or other protocols) for communicating with the server 140. One should appreciate that spouts 110, assigned devices 820, and other devices may be arranged in a hierarchy, with devices at different levels of the hierarchy having respective functions that differ from those of devices at other levels.

FIGS. 9-19 show example methods that may be carried out in connection with the environment 100. Such methods are typically performed, for example, by the software constructs described in connection with FIGS. 3 and 4, which reside in the memory 340 of the spout 110 and are run by the set of processors 330, and/or which reside in the memory 440 of the server 140 and are run by the set of processors 430. The various acts of these methods may be ordered in any suitable way. Accordingly, embodiments may be constructed in which acts are performed in orders different from those illustrated, which may include performing some acts simultaneously.

Figure 9:
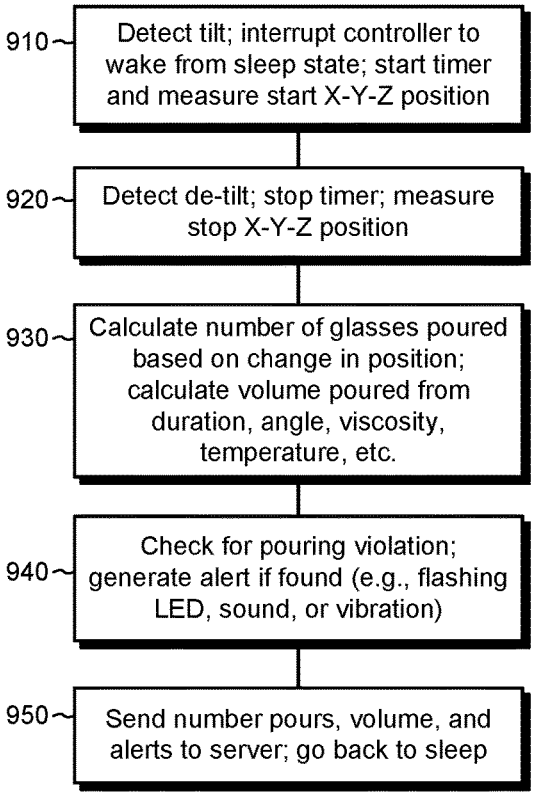
FIG. 9 is a flowchart showing an example method of monitoring beverage pours in the environment of FIG. 1.
Figure 9:
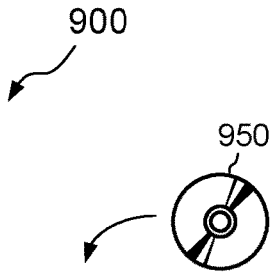

FIG. 9 shows an example method 900 of monitoring beverage pours in the environment of FIG. 1. Method 900 includes depicted acts 910, 920, 930, 940, and 950. As the intelligent spout 110 tracks its own orientation and position in three-dimensional space, it can easily distinguish single long pours from multiple short pours by detecting its own horizontal movement along a line of cups or glasses.

In some examples, the spout 110 measures an amount of beverage poured by repeatedly sampling the IMU 270 over time. In some examples, the spout 110, server 140, or other component (such as assigned device 820) stores viscosity data for the particular beverage being poured, and the volume poured from the spout 110 is further estimated based on viscosity. In some arrangements, the spout 110, server 140, or other device measures local temperature, and the volume poured is further estimated based on temperature.

In some examples, the spout 110 varies a sampling rate of the IMU 270 based on a detected angle of the spout 110. For instance, the spout 110 may sample the IMU 270 at a higher rate within the interval of the pour and at a lower rate outside that interval.

In some examples, the spout 110 operates in a low-power sleep state when the IMU 270 detects a stable, upright position, which is indicative of the bottle 120 sitting on a shelf or table 130. The spout 110 may make occasional measurements of the IMU 270 during the sleep state, such as once per second. In response to detecting movement of the spout 270 based on IMU measurements, the spout 110 may exit the sleep state and enter an active state, during which it samples the IMU 270 at a higher rate. While operating in the active state, the spout 110 may measure any number of pours and may communicate its pour data to the server 140 or other component, e.g., over the Bluetooth connection. The spout 110 may return to the sleep state after detecting that it has returned to a stable, upright position, e.g., in response to a determined interval of low IMU activity.

Figure 10:
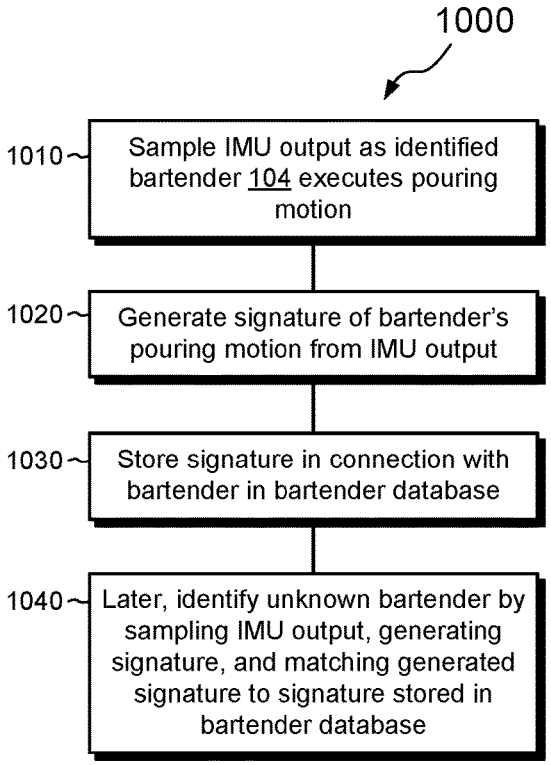
FIG. 10 is a flowchart showing an example method of identifying bartenders or other service personnel based on kinematic signatures of pouring motions.

FIG. 10 shows an example method 1000 of identifying bartenders or other service personnel based on kinematic signatures of pouring motions. Method 1000 includes depicted acts 1010, 1020, 1030, and 1040. In an example, the spout 110 uses kinematics engine 380 to receive input from the IMU 270 and monitor acceleration, orientation, and/or position of the spout 110. By recording these factors for a particular bartender 104 over multiple pours, the kinematics engine 380 may generate a characteristic of pours associated with that bartender. For example, each bartender 104 has a particular pouring signature. Once a bartender's pouring signature has been characterized, the signature may be used as a basis for uniquely identifying that bartender and distinguishing that bartender from other bartenders. In this manner, the spout 110 and/or server 140 can associate a particular pour with a specific person, enabling pouring patterns of that person, such as overpours and underpours, to be determined and recorded. In some examples, the acts of characterizing and matching pouring signatures involve machine learning and/or neural networks, such as convolutional neural nets.

Figure 11:
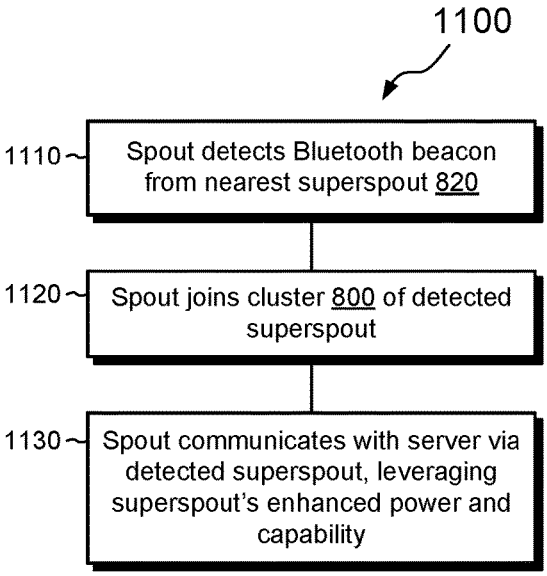
FIG. 11 is a flowchart showing an example method whereby a spout joins a cluster of spouts having a super-spout.

FIG. 11 shows an example method 1100 whereby a spout joins a cluster of spouts having a superspout. Method 1100 includes depicted acts 1110, 1120, and 1130. As described in connection with FIG. 8, a bar may include multiple serving stations 800 at respective locations. Each serving station 800 may have an assigned device 820 that broadcasts an electromagnetic beacon, such as a Bluetooth beacon. Spouts 110 may detect the nearest beacon and join the cluster from which the beacon originates. In some examples, assigned devices 820 may act as communication gateways for spouts 110 belonging to respective clusters 810, using short-range Bluetooth signals with spouts in the same clusters but using longer range signals (Bluetooth or otherwise) for communication with the server 140.

Figure 12:
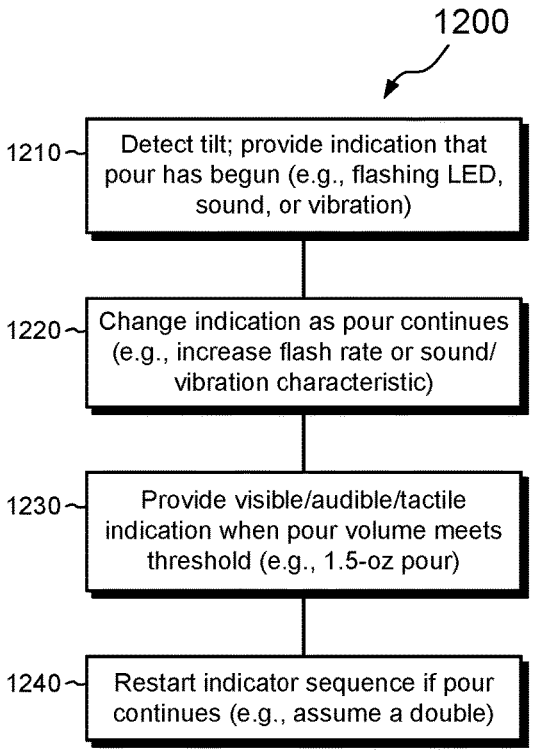
FIG. 12 is a flowchart showing an example method of providing feedback to a bartender or other service personnel regarding progress toward completing a pour.

FIG. 12 shows an example method 1200 of providing feedback to a bartender 104 regarding progress toward completing a pour. Method 1200 includes depicted acts 1210, 1220, 1230, and 1240. As shown, a spout 110 may communicate progress toward a complete pour using the indicators, such as transducer 114 or LED(s) 116. For example, the spout 110 may start flashing a LED 116 at the start of a pour, flash faster as the pour progresses, and turn solid when the pour is complete. The bar may establish a complete pour as a designated volume, such as 1.5 ounces, 2.0 ounces, or the like. If the pour continues after the spout 110 indicates completion, the spout 110 may restart the LED sequence, e.g., assuming that the pour is a double. In some examples, the spout 110 may activate an indicator in response to an overpour, alerting the bartender 104 that too much alcohol is being dispensed.

Figure 13:
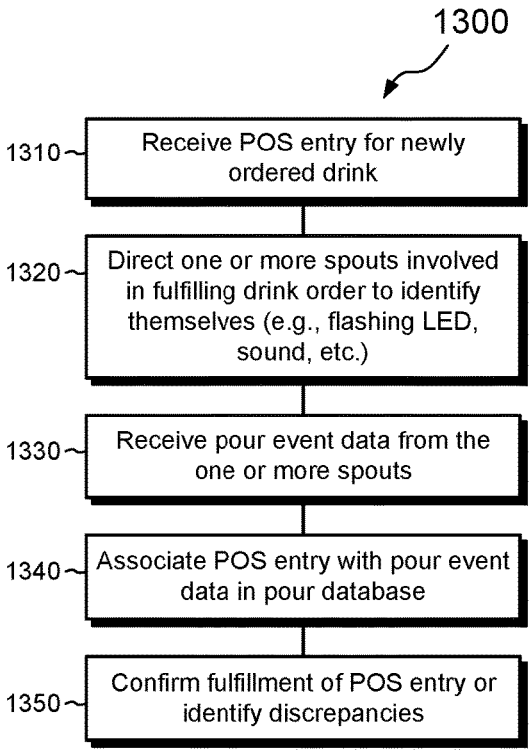
FIG. 13 is a flowchart showing an example method of associating a POS (Point-Of-Sale) order entry with one or more subsequent pour events.

FIG. 13 shows an example method 1300 of associating a POS (Point-Of-Sale) order entry with one or more subsequent pour events. Method 1300 includes depicted acts 1310, 1320, 1330, 1340, and 1350. Here, application 460 may associate a POS order entry with subsequent pours, e.g., pours that occur within a predetermined time interval following the POS entry. As the POS device 150 may receive particulars of the order, such as a type of mixed drink ordered, the application 460 may expect certain beverages to be poured. In some examples, the application 460 may direct the spouts 110 on bottles 120 needed to complete the order to illuminate (via a LED 116) or otherwise identify themselves, to guide the bartender 104 to the appropriate beverages. In some examples, the pour database 450*c* stores POS order data, thereby associating particular pours with corresponding orders.

Figure 14:
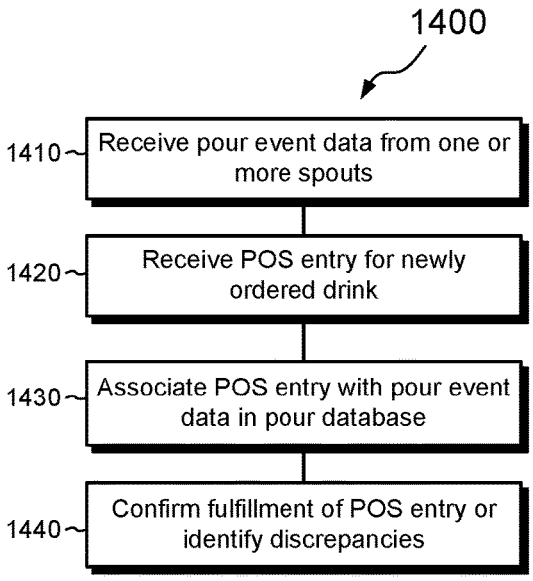
FIG. 14 is a flowchart showing an example method of associating one or more pour events with a subsequent POS order entry.

FIG. 14 shows an example method 1400 of associating one or more pour events with a subsequent POS order entry. Method 1400 includes depicted acts 1410, 1420, 1430, and 1440. In situations where a POS order is rung after pouring, the application 460 may associate the POS entry with prior pours, e.g., pours that occurred within a predetermined period prior to the POS entry. The ability to associate beverage pours with POS entries provides objective and auditable data. Such data may be used to establish fair prices for parties and other events.

Figure 15:
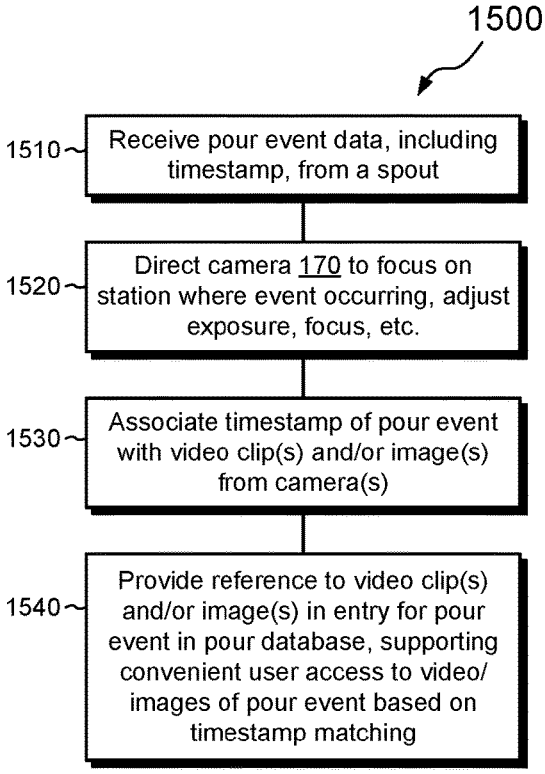
FIG. 15 is a flowchart showing an example method of associating pour events with video and/or still images acquired during the pour events.

FIG. 15 shows an example method 1500 of associating pour events with video and/or still images acquired during the pour events. Method 1500 includes depicted acts 1510, 1520, 1530, and 1540. As shown, spout activities may be integrated with cameras 170. For example, one or more cameras 170 may record video in the space 102. In response to a spout 110 detecting a pour event, the server 140 or other component may note the time (e.g., by generating a timestamp) and generate references (e.g., links) to video from the cameras 170 corresponding to the same point in time. The recordings may be rendered as short video clips, such as 30-second clips centered on the respective pour events. The server 140 may provide links to videos in the pour database 450*c*, such that users of the application 460 can easily view video associated with particular pours by clicking the corresponding links. Multiple links may be provided for viewing video from respective cameras.

In some examples, the cameras 170 may be controlled by a spout 110, the server 140, or some other device. For example, in response to a spout 110 detecting a pour event, the spout 110 or server 140 may direct one or more of the cameras 140 to focus on a particular area, to adjust exposure, and so forth. Cameras 170 may therefore operate in response to input from the spouts 110, server 140, or other devices.

Figure 16:
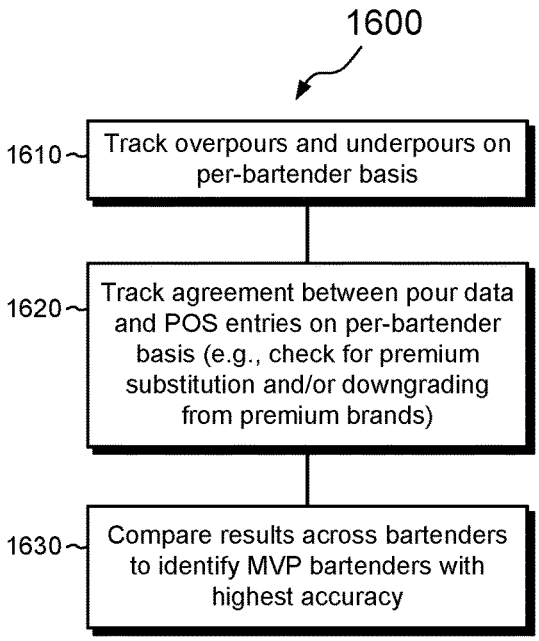
FIG. 16 is a flowchart showing an example method of gamifying service by bartenders and/or other service personnel by tracking associations between pour events and POS order entries.

FIG. 16 shows an example method 1600 of gamifying service by bartenders 104 by tracking associations between pour events and POS order entries. Method 1600 includes depicted acts 1610, 1620, and 1630. As shown, pouring performance of bartenders 104 may be gamified and compared with performance of other bartenders 104 to provide incentives and rewards. Pours recorded during a particular shift may be compared with POS data from the same shift to identify agreements and disparities. The application 460 can determine how many overpours and underpours were served, how many doubles were poured as singles or vice-versa, whether any substitutions were made (premium for rail or vice-versa) and the like. Scores may be tallied for different bartenders, providing objective measures of performance.

Figure 17:
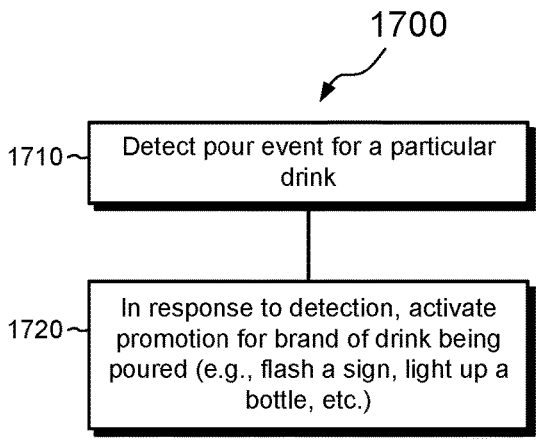
FIG. 17 is a flowchart showing an example method of delivering a promotion for a particular brand of drink ingredient in response to detecting a pour event for that brand of drink ingredient.

FIG. 17 shows an example method 1700 of delivering a promotion for a particular brand of drink ingredient in response to detecting a pour event for that brand of ingredient. Method 1700 includes depicted acts 1710 and 1720. As indicated, spouts 110 or other devices may respond to pour events by activating signs, lights, or other attention-attracting features to promote particular products. For instance, in response to detecting a pour event of a particular brand of beverage, a promotion for that brand may be illuminated or otherwise activated, letting persons in the vicinity know that the brand has been ordered. The promotions may extend to online services, such as social media platforms, which may register the pour data based on communication between the server and the social media platform.

Figure 18:
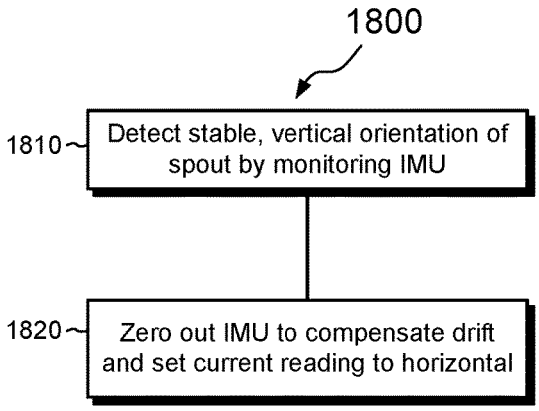
FIG. 18 is a flowchart showing an example method of correcting for drift of an IMU (inertial measurement unit) within a spout.

FIG. 18 shows an example method 1800 of correcting for drift of an IMU (inertial measurement unit) within a spout. Method 1800 includes depicted acts 1810 and 1820. As shown, a spout 110 may compensate for drift in the IMU 270 in response to a bottle 120 attached to the spout being placed vertically on the bar or other surface 130. For example, in response to detecting a period of low IMU activity, the spout 110 may assume it has been placed upright and correct its IMU 270 accordingly.

Figure 19:
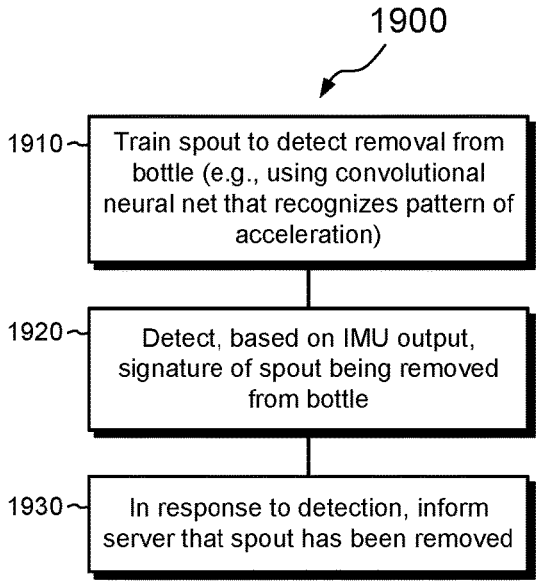
FIG. 19 is a flowchart showing an example method of detecting removal of a spout from a bottle based on IMU output.

FIG. 19 shows an example method 1900 of detecting removal of a spout from a bottle based on IMU output. Method 1900 includes depicted acts 1910, 1920, and 1930. As shown, removal of a spout 110 from a bottle 120 may be accompanied by a characteristic change in output from the IMU 270, based, for example, on initial stiction and then release. The spout 110 may generate an event in response to the detected removal and transmit that event to the server 140. Detecting removal in this manner prevents tampering and promotes accuracy in tracking total amounts of beverages poured.

Improved techniques have been described for monitoring dispensed liquids. Such techniques involve the use of an intelligent spout 110 that incorporates an IMU (Inertial Measurement Unit) 270 for tracking its own orientation and movement in three-dimensional space. The spout 110 has its own processor 330, memory 340, and wireless networking components 310, which support local data processing, data logging, and bi-directional wireless communication. Communication may be carried out with a server 140, with other spouts 110 of like kind, and/or with other devices, such as superspouts 820. As the intelligent spout 110 tracks its own orientation and position in three-dimensional space, it can easily distinguish single long pours from multiple short pours by detecting its own horizontal movement along a line of cups or glasses. As has been further described, the enhanced capabilities of the intelligent spout 110 enable many novel and useful applications.

Having described certain embodiments, numerous alternative embodiments or variations can be made. For example, embodiments may be constructed for measuring pours of other liquids besides alcoholic beverages and related drinks. These may include monitoring pours for food preparation, e.g., in a restaurant setting, for mixing paints, or for pouring liquids of any kind for any purpose.

Although features have been shown and described with reference to particular embodiments hereof, such features may be included and hereby are included in any of the disclosed embodiments and their variants. Thus, it is understood that features disclosed in connection with any embodiment are included in any other embodiment.

Further still, the improvement or portions thereof may be embodied as a computer program product including one or more non-transient, computer-readable storage media, such as a magnetic disk, magnetic tape, compact disk, DVD, optical disk, flash drive, solid state drive, SD (Secure Digital) chip or device, Application Specific Integrated Circuit (ASIC), Field Programmable Gate Array (FPGA), and/or the like (shown by way of example as medium 950 in FIG. 9). Any number of computer-readable media may be used. The media may be encoded with instructions which, when executed on one or more computers or other processors, perform the process or processes described herein. Such media may be considered articles of manufacture or machines, and may be transportable from one machine to another.

As used throughout this document, the words "comprising," "including," "containing," and "having" are intended to set forth certain items, steps, elements, or aspects of something in an open-ended fashion. Also, as used herein and unless a specific statement is made to the contrary, the word "set" means one or more of something. This is the case regardless of whether the phrase "set of" is followed by a singular or plural object and regardless of whether it is conjugated with a singular or plural verb. Also, a "set of" elements can describe fewer than all elements present. Thus, there may be additional elements of the same kind that are not part of the set. Further, ordinal expressions, such as "first," "second," "third," and so on, may be used as adjectives herein for identification purposes. Unless specifically indicated, these ordinal expressions are not intended to imply any ordering or sequence. Thus, for example, a "second" event may take place before or after a "first event," or even if no first event ever occurs. In addition, an identification herein of a particular element, feature, or act as being a "first" such element, feature, or act should not be construed as requiring that there must also be a "second" or other such element, feature or act. Rather, the "first" item may be the only one. Also, and unless specifically stated to the contrary, "based on" is intended to be nonexclusive. Thus, "based on" should not be interpreted as meaning "based exclusively on" but rather "based at least in part on" unless specifically indicated otherwise. Although certain embodiments are disclosed herein, it is understood that these are provided by way of example only and should not be construed as limiting.

Those skilled in the art will therefore understand that various changes in form and detail may be made to the embodiments disclosed herein without departing from the scope of the disclosure.

Table of Certain Reference Numerals

| Reference Numeral | Description |
|---|---|
| 100 | Example environment |
| 102 | Physical space |
| 104 | Bartender or other service personnel |
| 106 | Electronic bracelet |
| 110 | Intelligent spout |
| 120 | Bottle or other container of liquid |
| 122 | Mouth of bottle or container |
| 130 | Bar surface |
| 140 | Server apparatus |
| 150 | POS device |
| 160 | Desk or table |
| 170 | Camera |
| 180 | Router |
| 190 | Computer network and/or cloud |
| 210 | Enclosure |
| 210a | Circuit assembly |
| 212 | Spout label (e.g., ePaper) |
| 214 | Transducer |
| 216 | LED, e.g., multicolor |
| 220 | Barrel |
| 222 | Stopper rings |
| 230 | Inlet tube |
| 232 | Opening in inlet tube |
| 234 | Internal passageway |
| 240 | Outlet tube |
| 242 | Opening in outlet tube |
| 244 | Hole (for passageway) |
| 250 | Battery |
| 260 | Microcontroller |
| 270 | IMU (e.g., accelerometers and gyros) |
| 310 | Bluetooth interface (spout) |
| 320 | Drivers for LED, Piezo, eLabel, etc. |
| 330 | Processor(s) (spout) |
| 340 | Memory (spout, e.g., RAM, flash, etc.) |
| 350 | Local Orchestration |
| 360 | Pour detector |
| 370 | Data log (spout) |
| 380 | Kinematics engine |
| 410 | Bluetooth interface (server) |
| 420 | Network interface (e.g., Wi-Fi, Ethernet) |
| 430 | Processor(s) (server) |
| 440 | Memory (server; e.g., RAM, flash, etc.) |
| 450a | Spout database |
| 450b | Bartender database |
| 450c | Pour database |
| 450d | POS database |
| 450e | Promotion engine |
| 450f | Spout connector |
| 450g | Camera connector |
| 450h | POS connector |
| 450i | Cloud connector |
| 450j | Scheduler |
| 450k | Data log (server) |
| 450l | Machine learning engine |
| 450m | Neural net(s) |
| 460 | App/GUI |
| 800 | Station |
| 810 | Cluster of spouts |
| 820 | Superspout |
| 830 | AC power outlet |
| 950 | Computer program product |

What is claimed is:

1. A spout configured to attach to a mouth of a bottle, the spout comprising:

a passageway extending through the spout and configured to pass liquid out of the bottle;

an IMU (inertial measurement unit) configured to track orientation and movement of the spout in three-dimensional space;

wireless communication circuitry configured to communicate bidirectionally with other electronic equipment that is not part of the spout; and a pour detector constructed and arranged to detect a pour event and to compute, based on measurements from the IMU, horizontal translation of the spout during the pour event.

2. The spout of claim 1, further comprising a visual indicator, visible from outside the spout and configured to convey visual information to a user.

3. The spout of claim 2, wherein the visual indicator is configured to convey the visual information based on at least one of (i) measurements made by the IMU and (ii) wireless communication between the spout and an element of the other electronic equipment.

4. The spout of claim 1, further comprising a transducer configured to convey sonic or other vibrational information to a user.

5. The spout of claim 4, wherein the transducer includes at least one of a speaker or piezoelectric device configured to convey the sonic or other vibrational information based on at least one of (i) measurements made by the IMU and (ii) wireless communication between the spout and an element of the other electronic equipment.

6. The spout of claim 1, further comprising a label, visible from outside the spout, which identifies a type of beverage to which the spout is assigned for use.

7. The spout of claim 6, wherein the label is an electronic label configured by the spout in response to wireless communication between the spout and an element of the other electronic equipment.

8. The spout of claim 1, wherein the spout is constructed and arranged to transmit information based on IMU measurements acquired during beverage pours to a server computer of the other electronic equipment.

9. The spout of claim 1, wherein the spout is one of multiple spouts configured to communicate with one another in a cluster formed based on physical proximity.

10. The spout of claim 1, further comprising a data log constructed and arranged to store IMU measurements associated with multiple pour events.

11. The spout of claim 1, further comprising a kinematic engine configured to associate measurements from the IMU during pour events with respective users.

12. A method of monitoring beverage pours, comprising:

providing a spout attached to a mouth of a bottle, the spout housing electronic circuitry that includes (i) an IMU (inertial measurement unit) and (ii) wireless communication circuitry configured to communicate bidirectionally with a server computer;

detecting, by the spout, a pour event based at least in part on the IMU measuring orientation and movement of the spout in three-dimensional space; and wirelessly transmitting information about the pour event to the server computer, wherein the snout includes a set of indicators conveying visual and/or sonic information based on at least one of (i) measurements made by the IMU and (ii) wireless communication between the spout and the server computer.

13. The method of claim 12, wherein conveying the visual and/or sonic information includes generating an indication of pouring progress during the pour event.

14. The method of claim 12, wherein conveying the visual and/or sonic information includes outputting an indication in response to the server computer identifying the spout as being associated with a beverage order.

15. The method of claim 12, further comprising translating the pour event into multiple pour events in response to the information about the pour event indicating a horizontal translation of the spout while the spout is in a tilted orientation.

16. The method of claim 12, further comprising the spout identifying a user of the spout based on receiving a wireless signal from a device worn by the user of the spout.

17. The method of claim 12, further comprising storing at least one database entry that associates the pour event with any of (i) a human person using the spout during the pour event, (ii) a POS (point of sale) entry for a particular drink order, and/or (iii) a video clip of the pour event acquired by a camera.

18. A method of monitoring beverage pours, comprising:

providing a spout attached to a mouth of a bottle, the spout housing electronic circuitry that includes (i) an IMU (inertial measurement unit) and iii) wireless communication circuitry configured to communicate bidirectionally with a server computer;

detecting, by the spout, a pour event based at least in part on the IMU measuring orientation and movement of the spout in three-dimensional space;

wirelessly transmitting information about the pour event to the server computer;

acquiring measurements by the IMU of position and orientation of the spout during the pour event;

generating a kinematic signature of the pour event based on the acquired measurements; and identifying a current user of the spout based at least in part on matching the kinematic signature to one of multiple previously-stored kinematic signatures for respective users of the spout.

* * * * *